United States Patent [19]

Abbey, III

[11] Patent Number: 4,487,046

[45] Date of Patent: Dec. 11, 1984

[54] TRANSITION FORMING SECTION FOR TUBE MILL

[75] Inventor: Nelson D. Abbey, III, Toledo, Ohio

[73] Assignee: Abbey Etna Machine Co., Perrysburg, Ohio

[21] Appl. No.: 635,471

[22] Filed: Jul. 27, 1984

Related U.S. Application Data

[63] Continuation of Ser. No. 396,305, Jul. 8, 1982, abandoned.

[51] Int. Cl.[3] ..... B21D 5/08

[52] U.S. Cl. ..... 72/52; 72/178; 72/181

[58] Field of Search ..... 72/51, 52, 176, 178, 72/181, 367, 368; 228/17, 147, 149, 151

[56] References Cited

U.S. PATENT DOCUMENTS

| | | | |
|---|---|---|---|
| 2,685,807 | 8/1954 | Hudson | 72/249 |
| 3,159,199 | 12/1964 | Ruple | 72/178 |
| 4,299,108 | 11/1981 | Kato et al. | 72/52 |

FOREIGN PATENT DOCUMENTS

| | | | |
|---|---|---|---|
| 1402769 | 11/1968 | Fed. Rep. of Germany | 72/52 |

*Primary Examiner*—E. Michael Combs
*Assistant Examiner*—Charles Rosenberg
*Attorney, Agent, or Firm*—Fraser, Barker Purdue & Clemens

[57] ABSTRACT

A transition forming unit is provided for forming a strip of U-shaped cross-sectional configuration into a generally annular shaped cross-sectional configuration. The forming process is performed by a plurality of roll assemblies adjustably mounted on a pair of spaced longitudinally extending beams, one disposed on each side of the longitudinal axis of the forming unit. The beams are adjustable in respect of the longitudinal axis of the forming unit. A hold down assembly is provided for controlling the alignment of the U-shaped strip as it passes through the forming unit. The roll assemblies are mounted on each beam to absorb thrust loads produced during the forming process.

5 Claims, 6 Drawing Figures

TRANSITION FORMING SECTION FOR TUBE MILL

This is a continuation of application Ser. No. 396,305, filed July 8, 1982, now abandoned.

BACKGROUND OF THE INVENTION

This invention generally relates to tube forming mills and, more particularly, to an intermediate transition section for forming a strip of metal having a U-shaped cross-sectional configuration into a tube typically having an annular cross-sectional configuration.

In the manufacture of welded metal tubing formed from a flat strip of material, the use of materials having high yield strength has created problems in the forming operation. More specifically, the high yield strength of the metal strip tends to cause the section being formed to "spring back" thereby causing an undesired cross-sectional configuration presenting alignment of the material being formed prior to its entry into the succeeding forming roll sections, such as passing from the transition section to the fin roll section of the mill.

A production of heavy gauge, large diameter tubing initially requires passing stock to be formed through a number of driven rollers to effect the break down or transformation of the flat strip into a strip of generally U-shaped cross-section. Thence, the U-shaped strip is transformed into a generally annular shaped cross-section by causing the strip to pass through a cluster or transition roll section prior to its entry into a fin roll assembly to assure proper alignment of the abutting edges of the formed strip preparatory to a seam welding operation. In such operations, the mill may be operated at speeds of typically of 80 feet per minute, for example. Accordingly, in the event of a "spring back" of the leading edge of the formed strip prior to entry into the fin roll assembly, the leading edge will strike the rolls causing damage to the leading edge of the strip being formed, the roll surfaces, and the supporting bearings necessitating repair and replacement and costly shutdown time.

These problems are compounded when heavy gauge strip stock is fed into the forming mill in discrete lengths rather than in continuous lengths requiring constant attention to the proper alignment of each length throughout the mill prior to entry into the fin pass rolls to assure to the proper alignment of the abutting edges preparatory to seam welding operations.

SUMMARY OF THE INVENTION

The present invention overcomes the above-described, as well as other problems of the prior art, by providing a tube mill having a transition forming section disposed between the outlet of the initial forming section and the inlet to the fin roll section which assures the proper alignment.

Briefly, the transition forming section includes a pair of elongate beams disposed in spaced relation to each other in a common plane, means for supporting the ends of each beam, means for moving the beams in synchronizism with each other, and a plurality of adjustable roll means affixed to each of the beams for shaping and controlling the formed strip so that the strip will enter the fin roll section in proper alignment preparatory to the welding of the abutting edges of the formed strip.

An object of the present invention is to produce a multiple roller transition unit for a tube forming mill wherein the transition unit employs identical rolls regardless of the location of the rolls in the section.

Another object of the invention is to produce a transition forming unit employing identical rolls which can be utilized to produce tubes of various sizes from metal stock of varying gauges.

A further object of the invention is to produce a transition forming unit employing a plurality of identical rolls along each side of the longitudinal axis of the unit wherein the rolls along each side are adjusted as a unit in synchronizism with each other.

DESCRIPTION OF THE DRAWINGS

The above, as well other objects and advantages of the invention will become readily apparent to one skilled in the art from reading the following detailed description of the preferred embodiment of the invention when considered in the light of the accompanying drawings, in which.

DETAILED DESCRIPTION OF THE PREFERRED EMBODIMENT

Figure 1:
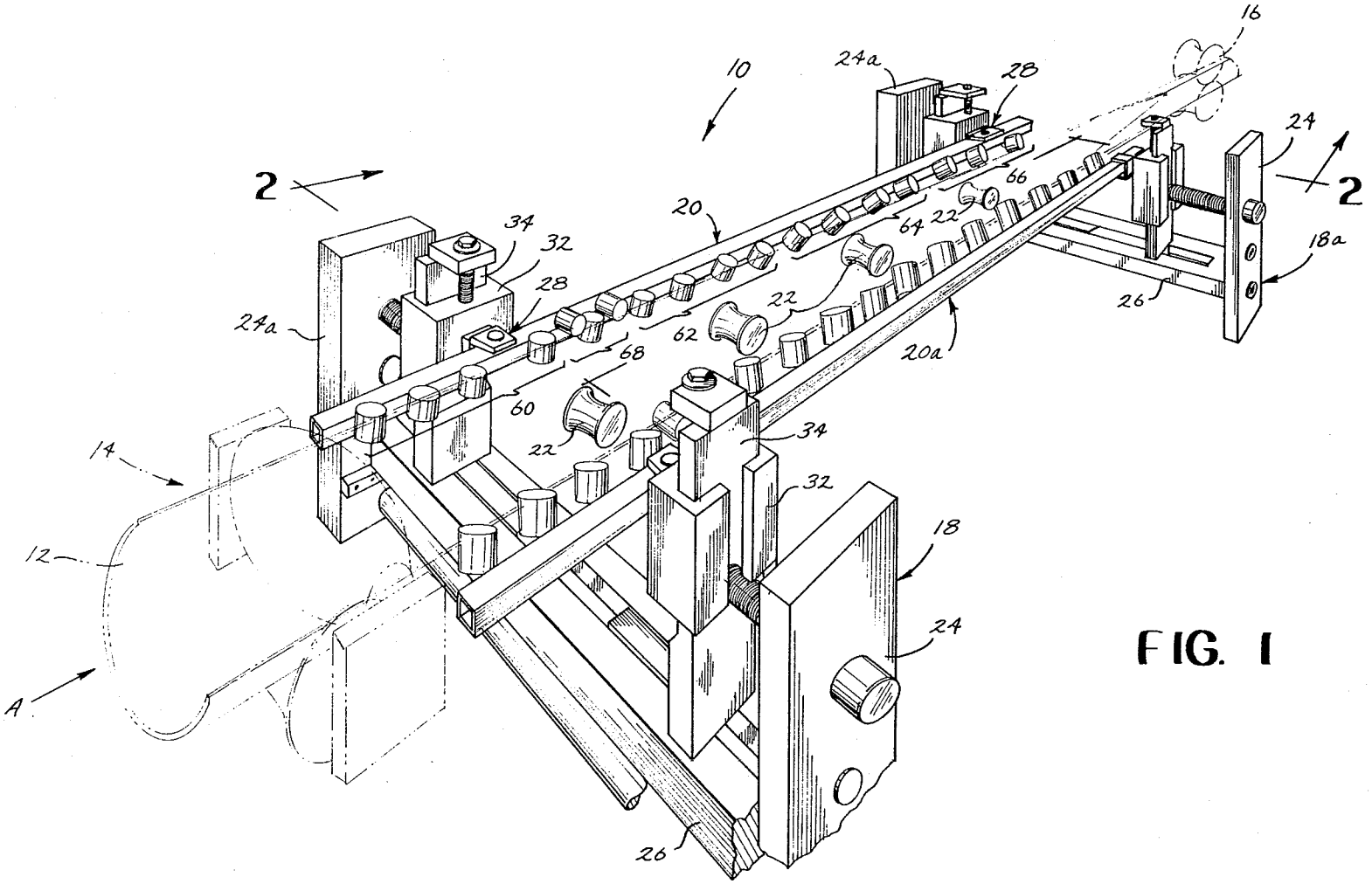
FIG. 1 is a perspective view of a transition forming unit constructed in accordance with the invention and adapted for use in a conventional tube mill.

In reference to the drawings, like reference numerals are employed to designated similar parts throughout the entire description. FIG. 1 shows, in schematic form, the overall structure of the transition roll forming unit, generally indicated by reference numeral 10, which incorporates the principal features of the invention. As illustrated in FIG. 1, the entry end of the forming unit 10 is disposed at the left hand side, while the exit end is at the right hand side.

The formation of metal tubing in mills of the type which could suitably incorporate the structure of the present invention, typically utilizes metal strip stock or skelp 12 from which the resultant tubing to be formed is fed from a driven pinch roll assembly (not shown) and thence into an initial forming section 14. The forming section 14 typically includes at least a pair of cooperating forming rolls at least one which is positively driven. During passage through the forming section 14, the cross-section of the metal strip is caused to be converted from a flat cross-sectional configuration to a generally U-shaped configuration. Accordingly, as the metal strip 12 exits from the forming section 14, it is U-shaped in cross-section so as to be received in the next forming section herein referred to as the transition section, generally indicated by reference numeral 10.

The transition station or section 10 typically includes a multiple roll assembly, an entrance stand 18 and an exit stand 18*a*. The stands 18 and 18*a* movably support the end of the longitudinally extending, spaced apart transition beams 20 and 20*a*, each of which is adapted to carry an identical number of different styles of individual roll assemblies. Further, the transition section 10 also includes a number of longitudinally spaced bottom support rolls 22 for supporting the bottom surface of the metal strip 12 as it travels through the various styles of roll assemblies of the forming station.

Figure 2:
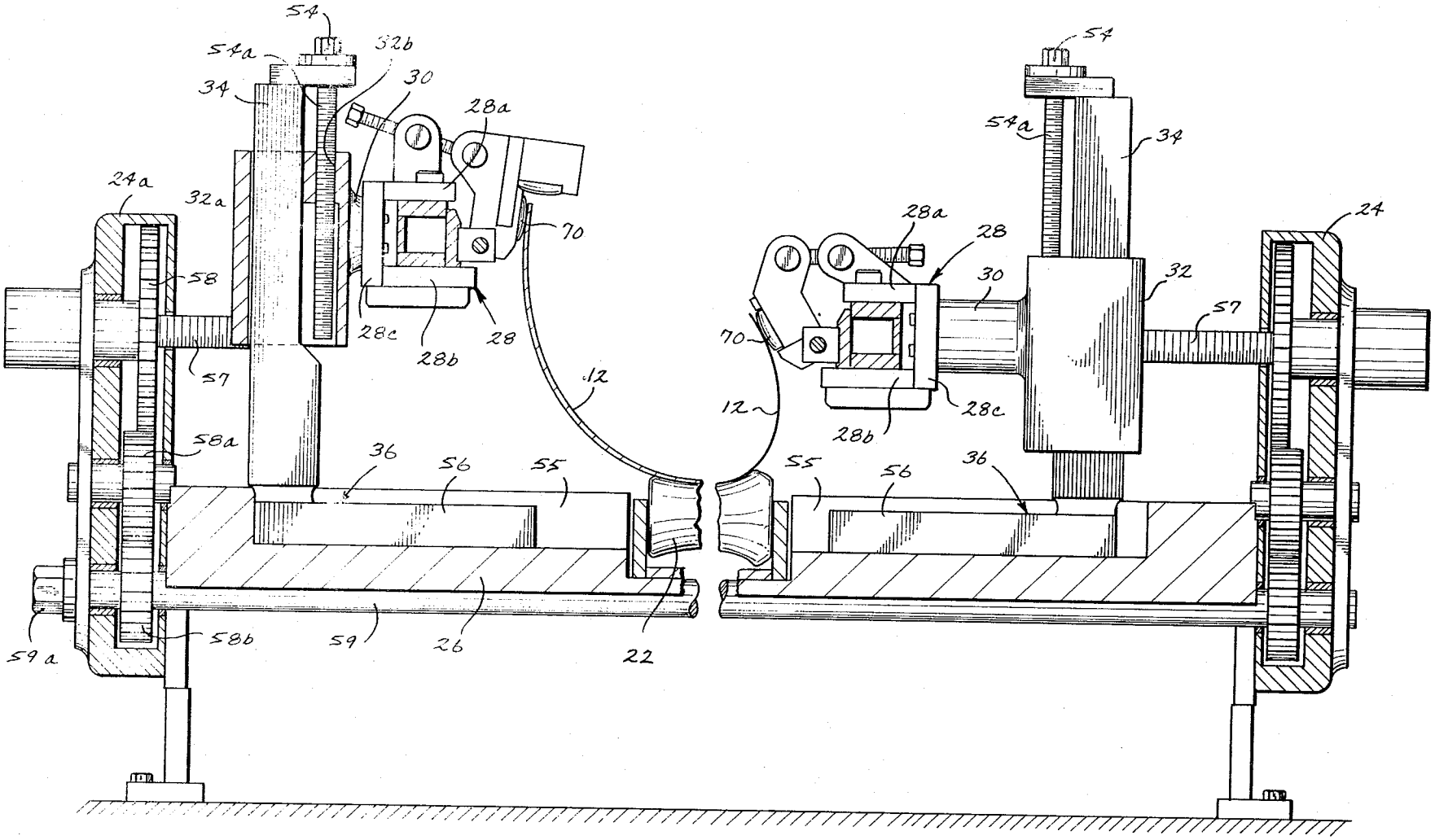
FIG. 2 is an enlarged vertical sectional view taken substantial along line 2—2 of FIG. 1 and illustrating the roll adjustment mechanism for two different sizes of tubing.

The stands 18 and 18*a*, illustrated in FIGS. 1 and 2, are aligned relative to each other and each extends transversely of the longitudinal axis of the transition section 10. The structure of each of the stands 18 and 18*a* is similar and for the ease of description, reference will made particularly to the stand 18. In this regard, the stands 18 and 18*a* each include a pair spaced apart upright members 24 and 24*a* interconnected by a base member 26 extending therebetween.

The longitudinally extending beams 20 and 20*a* are disposed in a common plane above and on opposite sides of the bottom support rolls 22. The beams 20 and 20*a* are mounted in such a fashion that the spacing between them decreases in a direction normal to the direction of travel of the metal strip 12. The direction of travel of the metal strip 12 is indicated by the arrow A in FIG. 1.

It will be noted that each of the beams 20 and 20*a* is mounted in a similar structural manner, such that synchronized horizontal and vertical movement may be readily effected. The beams 20 and 20*a* are coupled to and supported by its respective upright member 24 and 24*a* by means of a pivotally mounted clevis member 28. The clevis member 28 includes spaced apart, parallel, horizontally extending upper and lower arms 28*a* and 28*b*, respectively, joined by a connecting web 28*c*.

Figure 3:
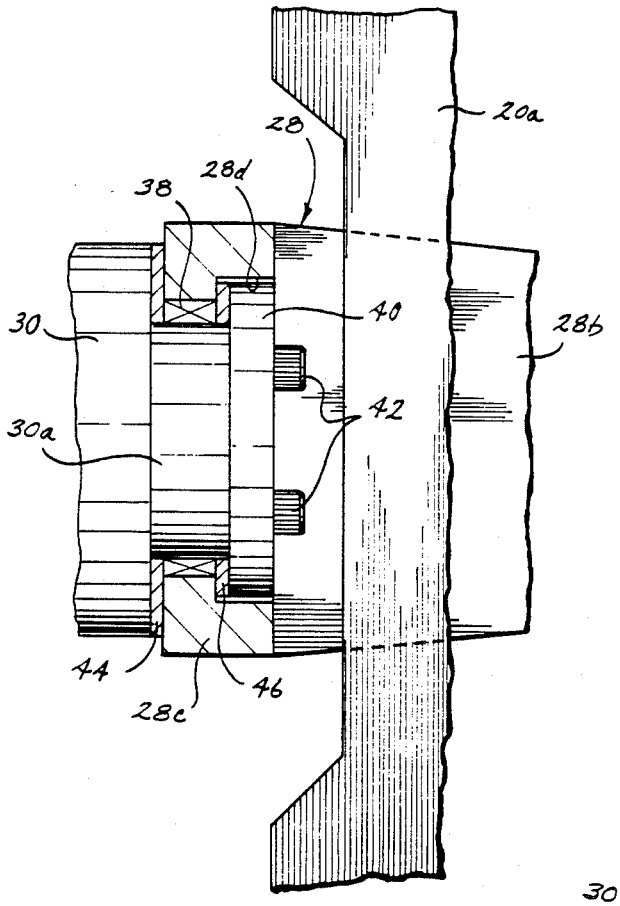
FIG. 3 is an enlarged fragmentary plan view of the rotational mounting mechanism employed for connecting the ends of the beams to the respective supporting stands as generally illustrated in FIG. 1.

The clevis 28 is rotatably connected to an arm 30 extending from and integral with a slide member 32 mounted for reciprocal vertical movement on an upwardly extending guiding support leg 34 of a generally L-shaped horizontally movable member 36. The innermost end of the arm 30 is provided with a stub shaft portion 30*a* (FIG. 3) which extends into a counterbored aperture 28*d* provided in the web 28*c* of the clevis 28.

A bearing 38, mounted on the stub shaft 30*a*, rotatably supports the clevis 28 and permits movement thereby of the end of the beams 20 and 20*a* relative to the shaft 30 during vertical and horizontal adjustments thereof, as will be explained in greater detail hereinafter, to avoid any binding or interference forces. A cap 40 affixed by cap screws 42 to the end of the stub shaft 30*a* secures the bearing 38 and the clevis 28 to the arm 30. Thrust washers 44 and 46 are provided on the opposite sides of the bearings 38 for absorbing thrust loads.

Figure 4:
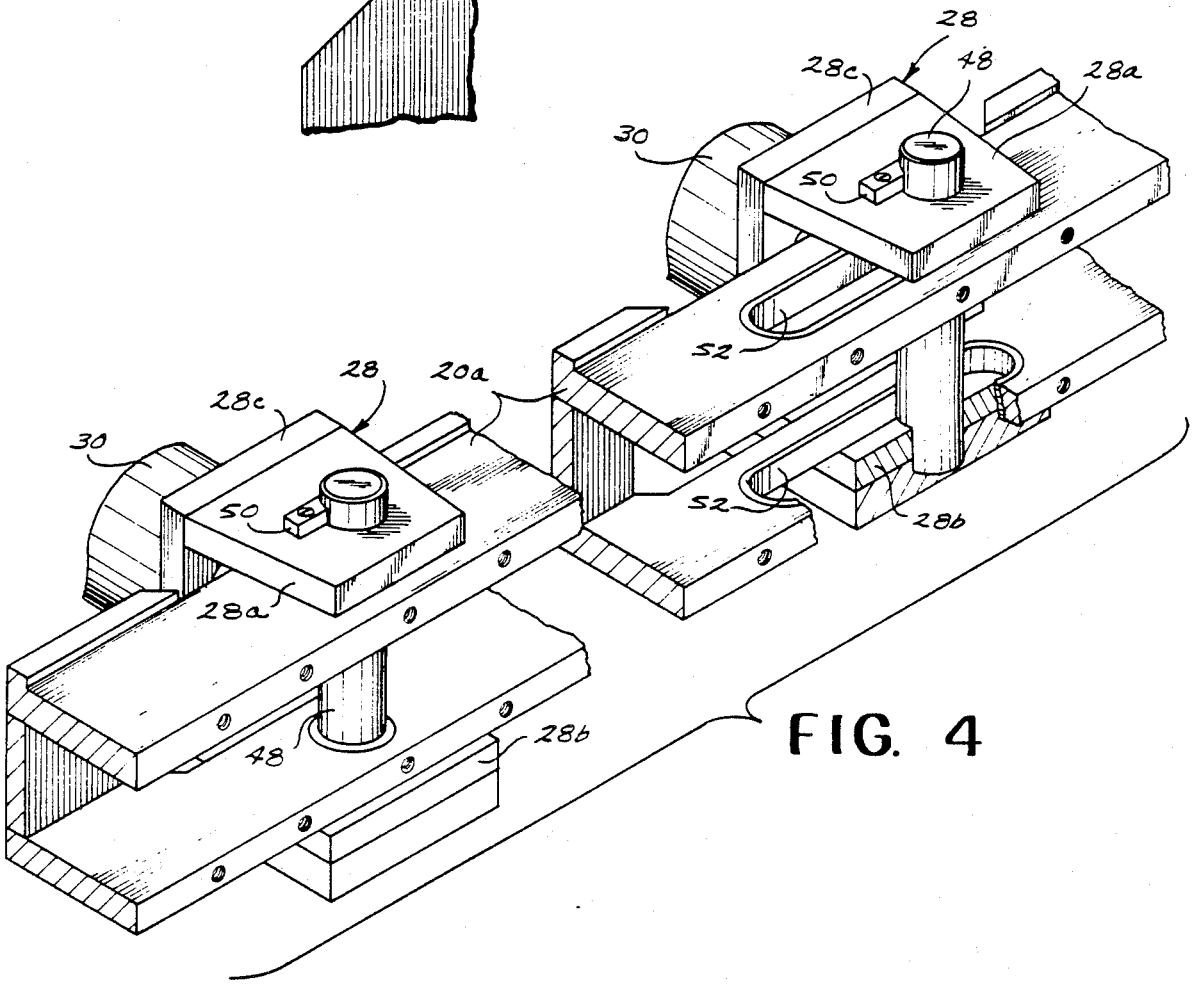
FIG. 4 is a fragmentary perspective view, partly in section, of one of the transition beams employed in the transition forming unit illustrated in FIG. 1.

Referring now to FIG. 4, the entrance end of each of the transition beams 20 and 20*a* of the transition section 10 is mounted for pivotal movement to the respective clevis 28 by a suitable pivot pin 48 extending through apertures provided in the clevis arms 28*a* and 28*b* and the associated beams 20 and 20*a*. The pivot pin 48 is secured in place by lock plate 50 suitably attached to the upper clevis arm 28*a*. The opposite exit end of each of the beams 20 and 20*a* is provided an elongated slot 52 adapted to receive the pivot pin 48 secured to the respective exit end clevis 28. It will be appreciated that the resultant structure provides for relative pivotal and longitudinal movement between the exit ends of the beams 20 and 20*a* and the respective clevis members 28.

The slide member 32 includes an upper portion 32*a* provided with a vertically extending internal threaded opening or bore 32 for receiving an externally threaded shank 54*a* of a rotary lead screw 54. The slide member 32 is formed to partially surround, in sliding relation, the upwardly extending leg 34 of the L-shaped platform 36. Accordingly, by rotating the lead screw 54, in one direction of rotation or the other, the vertical positioning of the clevis 28 and its associated end beam 20 or 20*a* may be achieved.

The base 56 of the L-shaped platform 36 is adapted to be guided for horizontal sliding movement in ways 55 which extend between the upright base members 24 and 24*a* and one side of the bottom support rolls 22. Movement of the L-shaped platform 36 is effected by a gear screw arrangement as illustrated in FIG. 2. One end of an externally threaded shank 57 is fixedly secured to the upwardly extending leg 34 of the platform 36, and the other end is received within the threaded interior of a gear 58 journalled for rotational movement about its axis within the base members 24 and 24*a*. It will be noted that rotational movement of the gear 58 is achieved through an associated idler gear 58*a* and a drive gear 58*b* both being suitably journalled for rotation within the upright members 24 and 24*a*. The drive gear 58*b* is keyed or otherwise affixed to a drive rod 59 which may be rotated by a head 59*a* integral with or affixed to one end of the drive rod 59. By turning the drive head 59*a*, rotational movement of the associated gears 58*b*, 58*a* and 58, will be achieved. Movement of the gear 58 in one direction will cause the threaded shank 57 to be drawn up within the internally threaded interior of the gear 58, while the opposite of the movement of the gear 58 will affect an opposite movement of the shank 57. Manifestly, since the threaded shank 57 has one of its ends secured to the sliding platform 36, the rotational movement of the gear 58 will simultaneously effect a sliding movement of the associated platform 36 and the associated beams 20 and 20*a* along the supporting ways 55.

As shown in FIG. 1, there is a series of four forming roll assemblies 60, 62, 64 and 66, and a hold down roll assembly 68 which cooperate to comprise the transition section 10. Each of the roll assemblies 60, 62, 64, and 66 is substantially identical and only a single one need be described in detail for a complete understanding. Each of the roll forming assemblies 60, 62, 64, and 66 is suitably secured, in a predetermined relationship to the longitudinally extending transition beams 20 and 20*a*.

Figure 5:
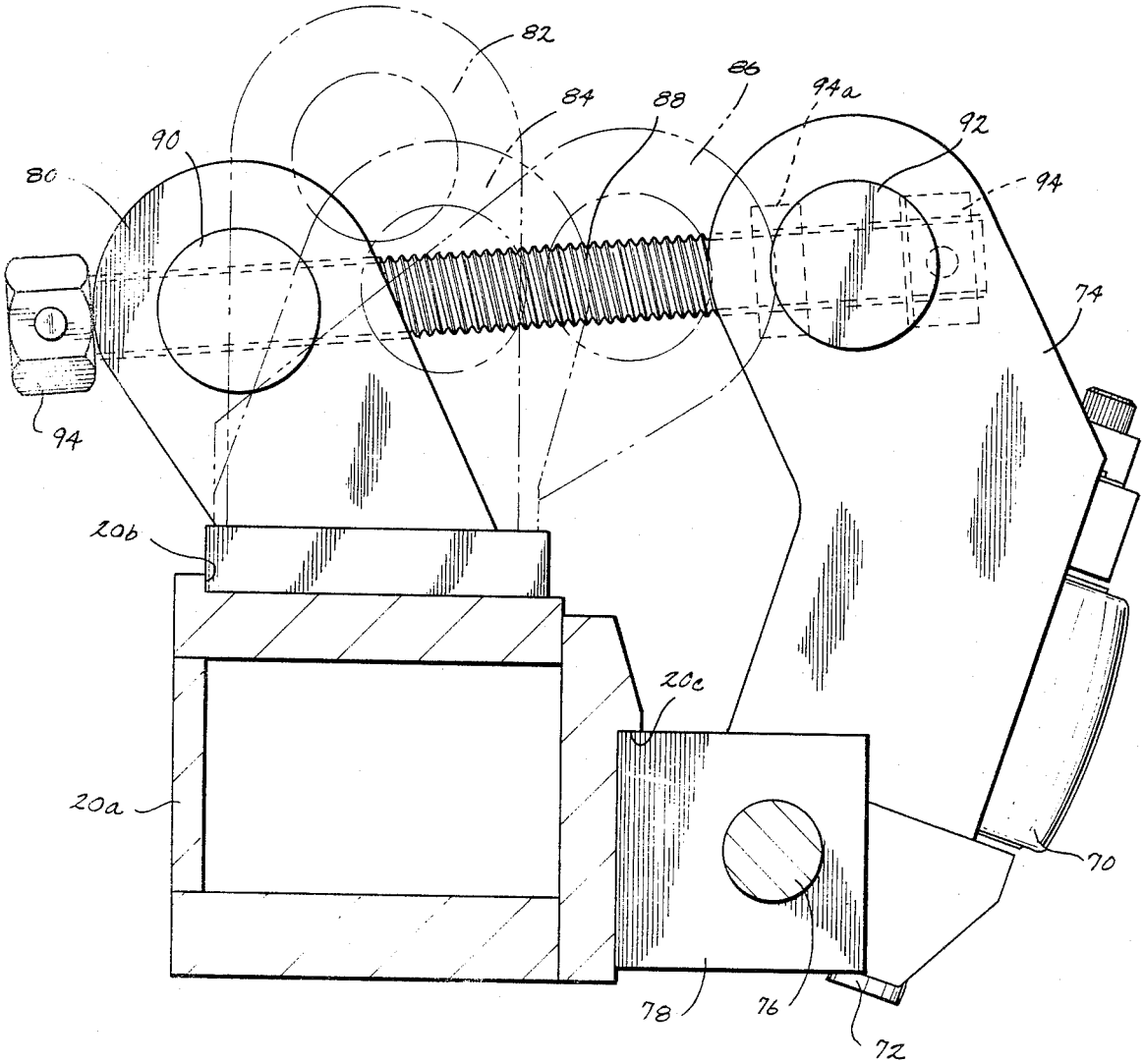
FIG. 5 is an enlarged sectional view illustrating the forming roll assembly in full lines and variations thereof in phantom lines.

It will be appreciated that each of the roll assemblies includes a transition roll 70, rotatably journalled on a shaft 72 secured to a roll housing 74, as clearly illustrated in FIG. 5. The lower end of the roll housing 74 is pivotally mounted on a shaft 76 secured in a pivot block 78 suitably secured to the front face of the associated transition beams 20 and 20*a*.

In order to pivotally move the roll housing 74 about its associated pivot shaft 76, angle blocks 80, 82, 84, and 86 for the roll assemblies 60, 62, 64, and 66, respectively, are suitably attached to the top surface of each transition beam 20 and 20*a*. Since the angular adjustment of each roll assembly 60, 62, 64, and 66 is substantially identical, only one adjustment structure will be described. An adjusting screw 88 is threadably engaged within an internally threaded bore of a pivot pin 90 pivotally mounted in the upper portion of each angle block 80, 82, 84, and 86. The innermost end of the adjusting screw 88 is rotatably secured to an anchor pin 92 pivotally mounted within the upper end of the roll housing 74. The outermost end of the adjusting screw 88 is provided with a head 94. When the head 94 and the associated screw 88 are rotated in either direction, the screw 88 will move axially with respect to the angle block 80 causing the roll housing 74 to pivotally move about the pivot shaft 76. Since each assembly employs a different style angle block 80, 82, 84, and 86, the associated transition roll in each assembly can be positioned at different inclinations for the contact with the undersurface of the metal strip 12 to assist in forming the strip into a substantially angular cross-sectional configuration.

Figure 6:
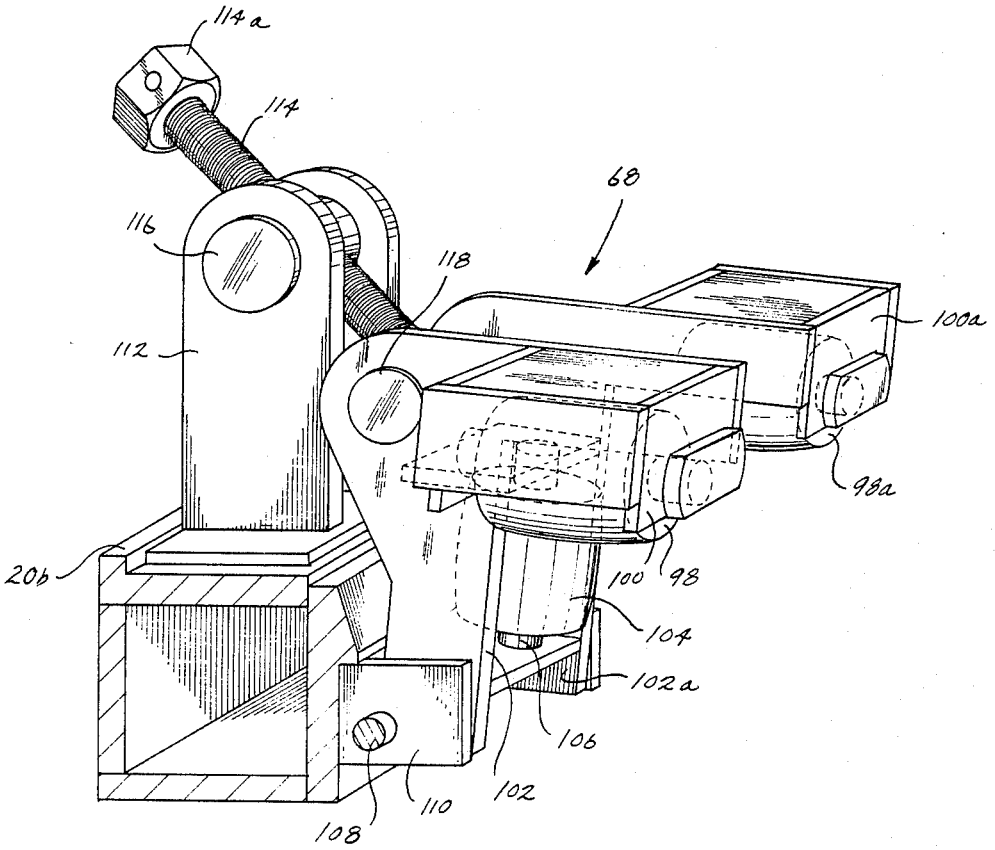
FIG. 6 is an enlarged perspective view of the hold down unit assembly employed in the transition unit illustrated in FIG. 1.

To assist in maintaining the desired alignment of the metal strip 12 and to militate against any tendency of the strip to rotate about the longitudinal axis of travel, hold down roll assemblies 68, as illustrated in FIG. 6, are employed.

It has been found that satisfactory results may be achieved by positioning at least one hold down roll assembly 68 between the transition roll assemblies 60 and 62, on each beam 20 and 20*a* as schematically illustrated in FIG. 1. Each of the hold down rolls assemblies 68 typically includes a pair of spaced apart hold down rolls 98 and 98*a* journalled for rotation about parallel axes within respective housings 100 and 100*a*.

The housings 100 and 100*a* are secured to the outside surfaces of a pair of spaced L-shaped brackets 102 and 102*a*, respectively, in a position so that the axes of the rows 98 and 98*a* are parallel to the plane of the edge of the strip 12 (see FIG. 2). A transition roll 104, rotatably journalled on a shaft 106 secured to the brackets 102 and 102*a*, is interposed between the spaced hold down rolls and a plane perpendicular to the plane containing the axes of the hold down rolls, as clearly shown in FIG. 6. The lower ends of the brackets 102 and 102*a* are pivotally mounted on a shaft 108 secured in a pivot lock 110 suitably secured to the front face of the associated transition beams 20 and 20*a*.

In order to pivotally move the L-shaped brackets 102 and 102*a* and the associated rolls about its pivot shaft 108, an angle block 112 is suitably attached to the top surface of each transition beam 20 and 20*a*. An adjusting screw 114 is threadably engaged within an internally threaded bore of a pivot pin 116 pivotally mounted in the upper portion of the angle block 112. The innermost end of the adjusting screw 114 is rotatably secured to an anchor pin 118 pivotally mounted within the upper corner portions of the L-shaped brackets 102 and 102*a*. The outermost end of the adjusting screw 114 is provided with a head 114*a*. When the head 114*a* and the associated screw 114 are rotated in either direction, the screw 114 will move axially with respect to the angle block 112 causing the L-shaped brackets 102 and 102*a* and the associated rolls to move about the pivot shaft 108. Accordingly, the transition roll 104 and the hold down rolls 98 and 98*a* of the hold down assembly 68 can be positioned at different inclinations for contact with the undersurface and edges of the metal strip 12, respectively, to assist in forming and aligning the strip 12 as it passes through the transition section 10.

The mounting of the transition roll assembly 60, 62, 64 and 66 and the hold down roll assembly 68 mounted on each beam 20 and 20*a* includes means for absorbing the thrust forces produced by the metal strip 12 as it tends to "spring back". To this end, shoulders are provided on the top and front faces of each beam 20 and 20*a* to bear against components of the transition roll assemblies and the hold down roll assembly. More specifically, the top face of each beam 20 and 20*a* is provided with a longitudinally extending shoulder 20*b* disposed to bear against the rear edge of the angle blocks 80, 82, 84 and 86 of the transition roll assemblies and the angle block 112 of the hold down roll assembly. The shoulder 20*b* is positioned on the top faces of the beams 20 and 20*a* to resist the horizontal component of the "spring back" forces. The front face of each beam 20 and 20*a* is provided with a longitudinally extending shoulder 20*c* disposed to bear against the upper edge of the pivot block 78 of the transition roll assemblies and the pivot block 110 of the hold down roll assembly. The shoulder 20*c* is positioned to resist the vertical components produced by the "spring back" forces.

In operation and referring specifically to FIG. 1, immediately after the entry of the metal strip 12 into the transition unit 10, the rolls of the assembly 60 nearest the entrance end of the transition unit 10 will contact the undersurface of the metal strip 12 at an inclination causing the edges thereof to be forced inwardly in a shallow curvature. In certain instances, when employing heavy gauge metal, for example, it may be desirable to employ a supplemental hold down roll assembly typically supported by the entrance stand 18 in any conventional manner. Such hold down roll assembly would be effective to continuously contact the central upper surface of the strip stock being formed to maintain the lower surface of the strip stock in contact with the roll 22 to effect the desired alignment of the strip with the forming rolls. The metal strip 12 then passes through the hold down roll assembly 68 where the pair of top rolls 98 and 98*a* retain the marginal edges of the metal strip 12 in a common horizontal plane while the transition roll 104 thereof contacts the undersurface of the strip 12 causing the edges to be forced inwardly in a deeper curvature. As the metal strip 12 moves toward the fin roll pass 16, the roller 70 of the transition roll assemblies 62, 64 and 66 cause the edges of the metal strip 12 to be curved to a more sharply arcuate configuration so that the metal strip 12 assumes a substantially annular cross-sectional shape preparatory to entering the conventional fin roll pass 16 without damage thereto.

One additional advantage of the apparatus illustrated and described involves the inherent ability to easily replace the transition beams 20 and 20*a* and the associated forming rolls with other transition beams having other sets of rolls for forming various diameter tubing. This objective is achieved by moving the various slide members 32 upwardly of the respective supporting legs 34 and removing them together with their associated transition beams. After removal, a new transition beam and associated rolls may be easily positioned such that the slide members may be slid downwardly of the respective legs 34 and, thence, refastening the vertical positioning means. Manifestly, transition sections of mills employing the invention may be easily and quickly changed to enable the mills to produce tubing of various sizes.

From the foregoing it can be seen that there is provided a transition roll section 10 particularly suited for forming a large diameter heavy gauge tubing wherein a multitude of identical small rolls may be employed in place of a few large specially shaped rolls. Moreover, the same rolls can be employed regardless of tube size and gauge. With such small identical individual rolls, individual adjustment of the rolls is eliminated once the proper location and inclination of all the rolls in the assemblies is set. This is achieved by mounting the rolls on common beams wherein the entrance ends of the beams are pivotally attached to and an adjusting mechanism by a rotatable clevis and the exit ends of the beams are attached to an adjusting device by a lost motion device and a rotary clevis (see FIG. 4).

In accordance with the provisions with the patent statute, the principle and mode of operation of the invention has been explained and what is considered to represent its preferred embodiment has been illustrated and described. It should, however, be understood that the invention may be practiced otherwise than as specifically illustrated and described without departing from the spirit and scope.

I claim:

1. A transition forming unit having a longitudinally extending axis for producing a tubing of annular cross-sectional configuration from a strip of U-shaped cross-sectional configuration traveling along the longitudinal axis of the forming unit, comprising:

a pair of longitudinally extending beams each having an axis, one disposed on each side of and extending along the longitudinally extending axis of the transition forming unit;

a plurality of spaced apart roll assemblies extending longitudinally along each of said beams, each of said roll assemblies including at least one roller adapted to engage the outer surface of the strip being formed and a separate first adjustment means for moving said roller to a predetermined position relative to the axis of said beam on which said roll assembly is mounted; and second adjustment means for vertically and horizontally moving said beams to orient the axes of the beams in selected positions relative to the axis of the forming unit, said second adjustment means operable to simultaneously adjust the vertical positions of said roll assemblies relative to the axis of the forming unit and to simultaneously adjust the horizontal portions of said roll assemblies relative to the axis of the forming unit while maintaining each of said rollers of said roll assemblies in said predetermined positions relative to the axes of said beams.

2. The invention defined in claim 1 wherein said beams include means for absorbing thrust loads produced by the forming of a U-shaped strip into an annular configuration.

3. The invention defined in claim 1 wherein said second adjustment means includes at least two longitudinally spaced support stands for mutually mounting the ends of said beams including means operative to shift the ends of said beams along respective horizontal paths relative to and in synchronism with each other, and means operative to change the vertical position of the ends of said beams.

4. The invention defined in claim 3 including rotary bearings mounting the ends of said beams in said support stands.

5. The invention defined in claim 3 wherein said means operative to shift the ends of said beams includes pivotal means disposed at opposite extremities of said beams, at least one of each pivotal means including a slotted aperture and fixed pin arrangment.

* * * * *